US009500986B2

(12) United States Patent
Yamagishi

(10) Patent No.: US 9,500,986 B2
(45) Date of Patent: Nov. 22, 2016

(54) TONER CASE AND IMAGE FORMING APPARATUS

(71) Applicant: KYOCERA Document Solutions Inc., Osaka (JP)

(72) Inventor: Rei Yamagishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/899,245

(22) PCT Filed: May 22, 2015

(86) PCT No.: PCT/JP2015/064775

§ 371 (c)(1),
(2) Date: Dec. 17, 2015

(87) PCT Pub. No.: WO2015/186540

PCT Pub. Date: Dec. 10, 2015

(65) Prior Publication Data

US 2016/0147178 A1 May 26, 2016

(30) Foreign Application Priority Data

Jun. 3, 2014 (JP) ..... 2014-114688

(51) Int. Cl.
*G03G 15/08* (2006.01)

(52) U.S. Cl.
CPC ..... *G03G 15/0877* (2013.01)

(58) Field of Classification Search
CPC ..... G03G 15/0832; G03G 15/0877; G03G 2215/066
See application file for complete search history.

(56) References Cited

U.S. PATENT DOCUMENTS

| | | | | |
|---|---|---|---|---|
| 5,419,468 A * | 5/1995 | Taki | G03G 15/0855 | 222/554 |
| 2005/0185990 A1* | 8/2005 | Ahn | G03G 15/0855 | 399/258 |
| 2010/0104327 A1* | 4/2010 | Handa | G03G 15/0881 | 399/263 |

FOREIGN PATENT DOCUMENTS

| | | | |
|---|---|---|---|
| JP | 05-055161 | U | 7/1993 |
| JP | 07-044000 | A | 2/1995 |
| JP | 2000-187382 | A | 7/2000 |
| JP | 2005-338397 | A | 12/2005 |
| JP | 2007-148320 | A | 6/2007 |
| JP | 2007-212766 | A | 8/2007 |
| JP | 2007-304264 | A | 11/2007 |
| JP | 2008-292729 | A | 12/2008 |
| JP | 2009-145806 | A | 7/2009 |

OTHER PUBLICATIONS

International Search Report—PCT/JP2015/064775 dated Jun. 23, 2015.

* cited by examiner

*Primary Examiner* — Sandra Brase
(74) *Attorney, Agent, or Firm* — Studebaker & Brackett PC

(57) ABSTRACT

A toner case (6) according to the present invention includes a case main body (22) and a dividing member (23). The case main body (22) is configured to have a filling port (32) through which a toner is filled and a discharging port (42) through which the toner is discharged. The dividing member (23) is configured to divide an internal space of the case main body (22) into a first space (S1) communicated with the filling port (32) and the discharging port (42) and a second space (S2) restrained from communication with the filling port (32) and the discharging port (42).

11 Claims, 12 Drawing Sheets

TONER CASE AND IMAGE FORMING APPARATUS

TECHNICAL FIELD

The present invention relates to a toner case configured to contain a toner and an image forming apparatus including the toner case.

BACKGROUND ART

Conventionally, an electrographic image forming apparatus performs a developing process by supplying a toner from a development device to an electrostatic latent image formed on a surface of a photosensitive drum or the like. Further, the toner used for the developing process is supplied from a toner case to the development device. For example, Patent Document 1 discloses a toner case including a case main body which contains a toner.

[Patent Document 1] Japanese Unexamined Patent Application, Publication No. hei 7-44000

SUMMARY OF INVENTION

Technical Problem

In the toner case described in Patent Document 1, there is a case that a filling amount of the toner to the case main body is preferably varied according to the specification of the image forming apparatus. However, it is difficult for a conventional toner case to meet above-mentioned request by a simple configuration.

Taking the above-mentioned situation into consideration, an object of the present invention is to vary the filling amount of the toner to the case main body by a simple configuration.

Solution to Problem

A toner case according to the present invention includes a case main body and a dividing member. The case main body is configured to have a filling port through which a toner is filled and a discharging port through which the toner is discharged. The dividing member is configured to divide an internal space of the case main body into a first space communicated with the filling port and the discharging port and a second space restrained from communication with the filling port and the discharging port.

An image forming apparatus according to the present invention includes the above-mentioned toner case.

Advantageous Effects of Invention

The present invention makes it possible to vary the filling amount of the toner to the case main body by a simple configuration.

DESCRIPTION OF EMBODIMENTS

First Embodiment

Figure 1:
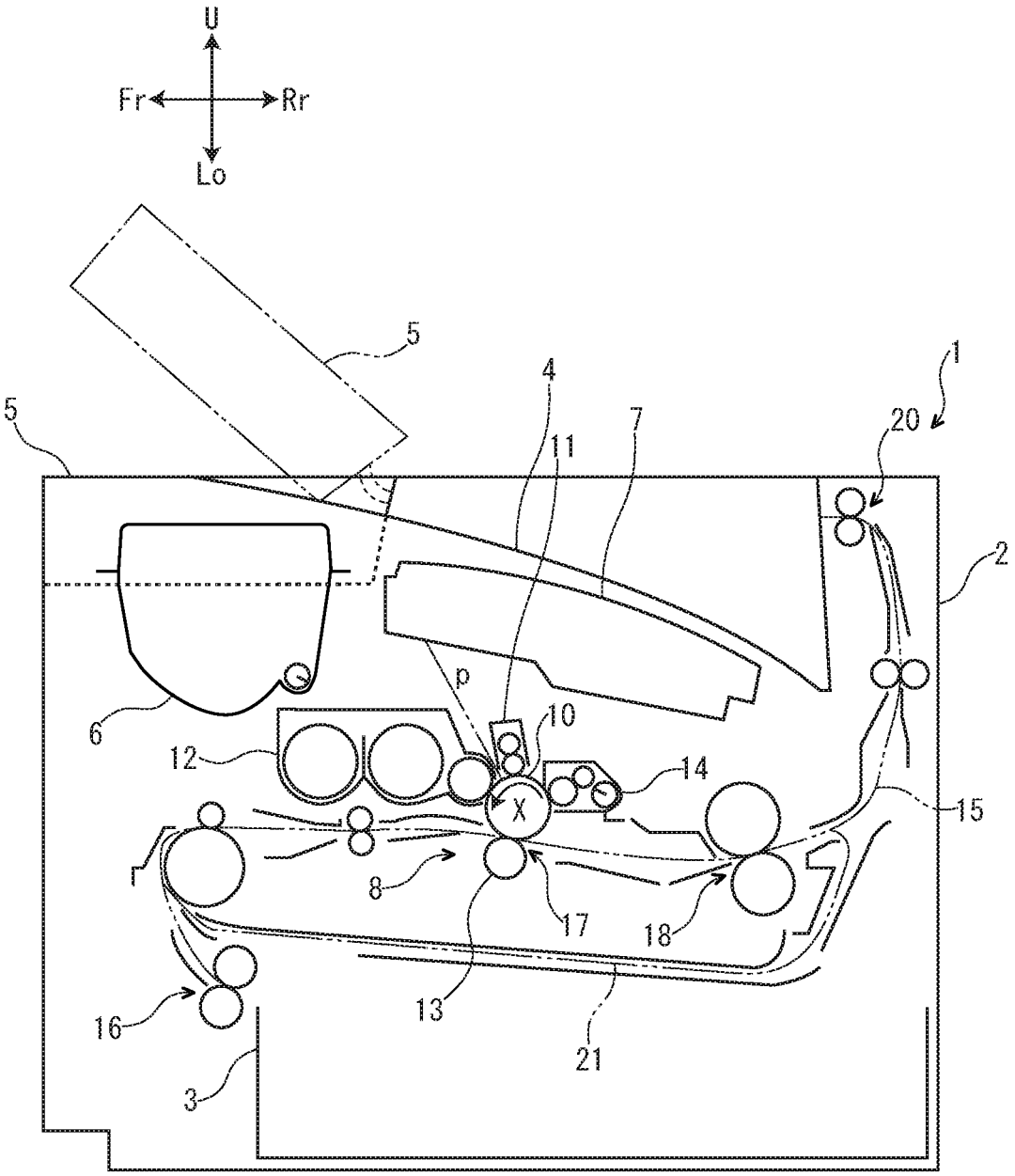
FIG. 1 is a schematic view showing an outline of a printer according to a first embodiment of the present invention.

First, with reference to FIG. 1, the entire structure of an electrographic printer 1 (an image forming apparatus) will be described. Hereinafter, it will be described so that the front side of the printer 1 is positioned at a left side of FIG. 1. Arrows Fr, Rr, L, R, U and Lo appropriately added to each of the drawings indicate a front side, a rear side, a left side, a right side, an upper side and a lower side of the printer 1, respectively.

The printer 1 includes a box-formed printer main body 2. In a lower part of the printer main body 2, a sheet feeding cartridge 3 configured to store sheets (not shown) is installed and, on a top surface of the printer main body 2, a sheet ejecting tray 4 is arranged. On the top surface of the printer main body 2, an upper cover 5 is openably/closably attached at a front side of the sheet ejecting tray 4 and, below the upper cover 5, a toner container 6 (a toner case) is housed.

In an upper part of the printer main body 2, an exposure device 7 composed of a laser scanning unit (LSU) is installed below the sheet ejecting tray 4. Below the exposure device 7, an image forming part 8 is arranged. In the image forming part 8, a photosensitive drum 10 as an image carrier is rotatably installed. Around the photosensitive drum 10, a charger 11, a development device 12, a transfer roller 13 and a cleaning device 14 are located along a rotating direction (refer to an arrow X in FIG. 1) of the photosensitive drum 10.

Inside the printer main body 2, a sheet conveying path 15 is arranged. At an upper stream end of the conveying path 15, a sheet feeder 16 is arranged. At an intermediate stream part of the conveying path 15, a transferring part 17 composed of the photosensitive drum 10 and the transfer roller 13 is arranged. At a lower stream part of the conveying path 15, a fixing device 18 is arranged. At a lower stream end of the conveying path 15, a sheet ejecting part 20 is arranged. Below the conveying path 15, an inversion path 21 for duplex printing is arranged.

Next, an image forming operation by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, a surface of the photosensitive drum 10 is electrically charged by the charger 11. Then, exposure corresponding to the image data on the photosensitive drum 10 is carried out by a laser (refer to a two-dot chain line P in FIG. 1) from the exposure device 7, thereby forming an electrostatic latent image on the surface of the photosensitive drum 10. Subsequently, the development device 12 develops the electrostatic latent image to a toner image with a toner supplied from the toner container 6.

On the other hand, a sheet fed from the sheet feeding cartridge 3 by the sheet feeder 16 is conveyed to the transferring part 17 in a suitable timing for the above-mentioned image forming operation, and then, the toner image on the photosensitive drum 10 is transferred onto the sheet in the transferring part 17. The sheet with the transferred toner image is conveyed to a lower stream side of the conveying path 15 and goes into the fixing device 18, and then, the toner image is fixed on the sheet in the fixing device 18. The sheet with the fixed toner image is ejected from the sheet ejecting part 20 to the sheet ejecting tray 4. A toner remained on the photosensitive drum 10 is collected by the cleaning device 14.

Next, the toner container 6 will be described in detail.

Figure 2:
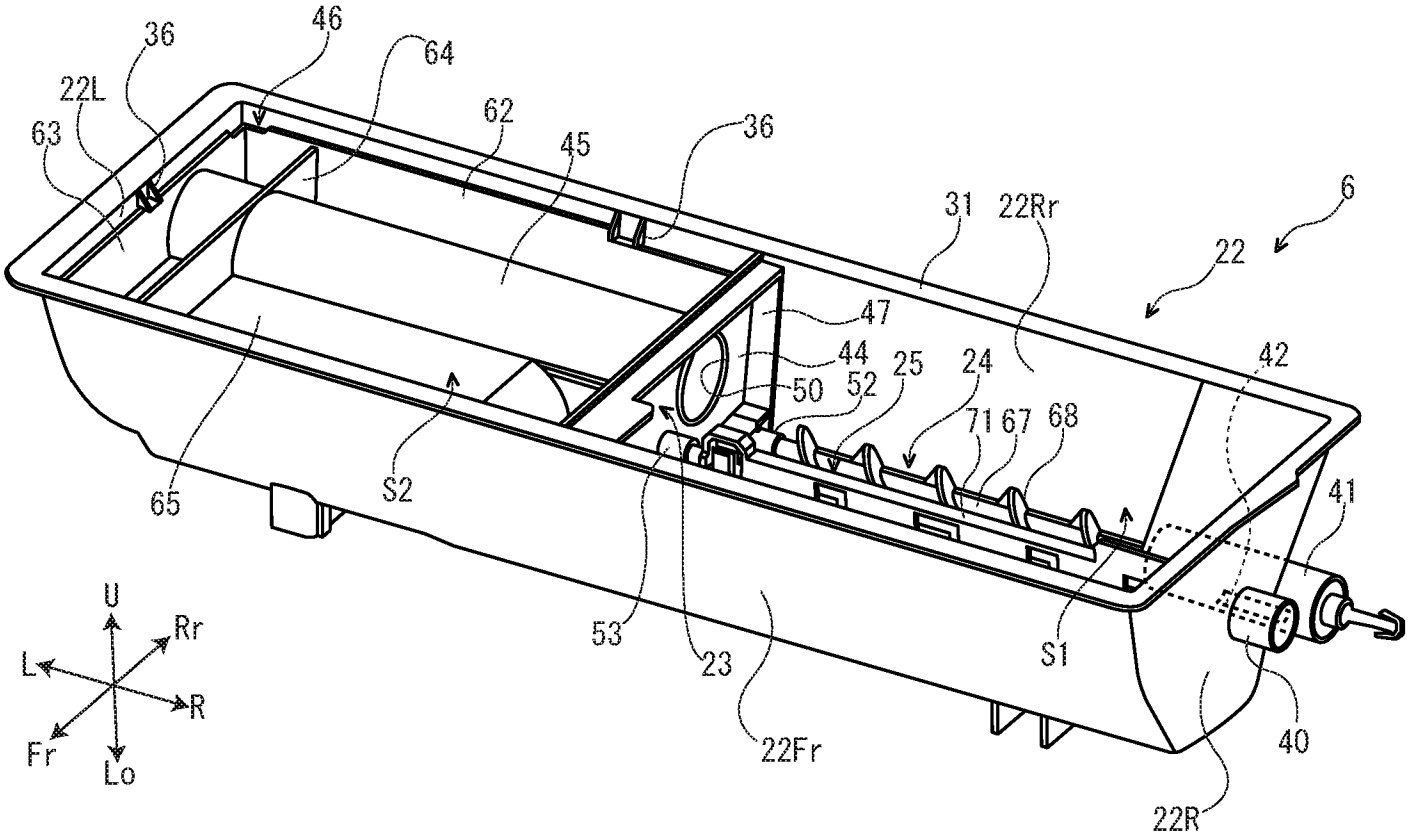
FIG. 2 is a perspective view showing an internal structure of a toner container according to the first embodiment of the present invention.
Figure 3:
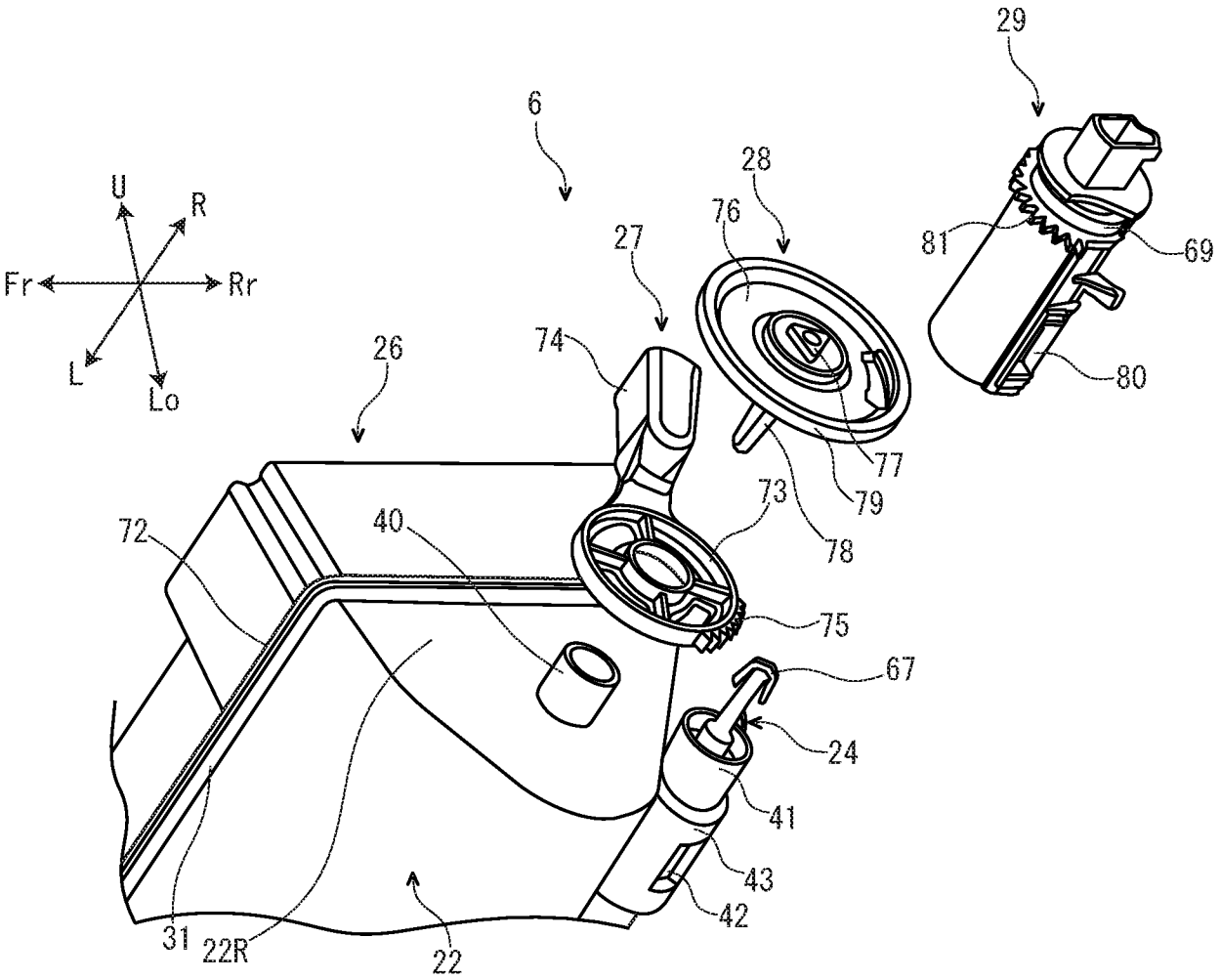
FIG. 3 is an exploded perspective view showing the toner container according to the first embodiment of the present invention.

As shown in FIGS. 2 and 3 and other figures, the toner container 6 includes a case main body 22 of a box shape whose top face is opened, a dividing member 23 which is housed in a left side part of the case main body 22, a conveying screw 24 (a rotating member) which is housed in a lower rear part of a right side part of the case main body 22, an agitating paddle 25 (a rotating member) which is housed in a nearly center of the right side part of the case main body 22, a covering body 26 which covers an upper side of the case main body 22, a lever 27 and a transmitting member 28 which are attached to a nearly center part of a right end part of the case main body 22 and a shutter 29 which is attached to a lower rear part of the right end part of the case main body 22. In addition, FIG. 2 does not show the covering body 26, the lever 27, the transmitting member 28 and the shutter 29.

As shown in FIG. 2 and other figures, the case main body 22 is formed in a shape elongated in a left and right direction. That is, in the present embodiment, the left and right direction is a longitudinal direction of the case main body 22. The case main body 22 includes an internal space. Hereinafter, a right side space of the internal space of the case main body 22 will be referred to as a "first space S1", and a left side space of the internal space of the case main body 22 will be referred to as a "second space S2". In the first space S1, a toner is filled.

At the lower rear part of the right end part of the case main body 22, a cylindrical discharging duct 41 is provided. At a bottom part of the discharging duct 41 (a part corresponding to the first space S1), a discharging port 42 through which the toner is discharged is arranged. At an outer circumference of the discharging port 42, a sealing piece 43 (see FIG. 3) is attached.

Figure 4:
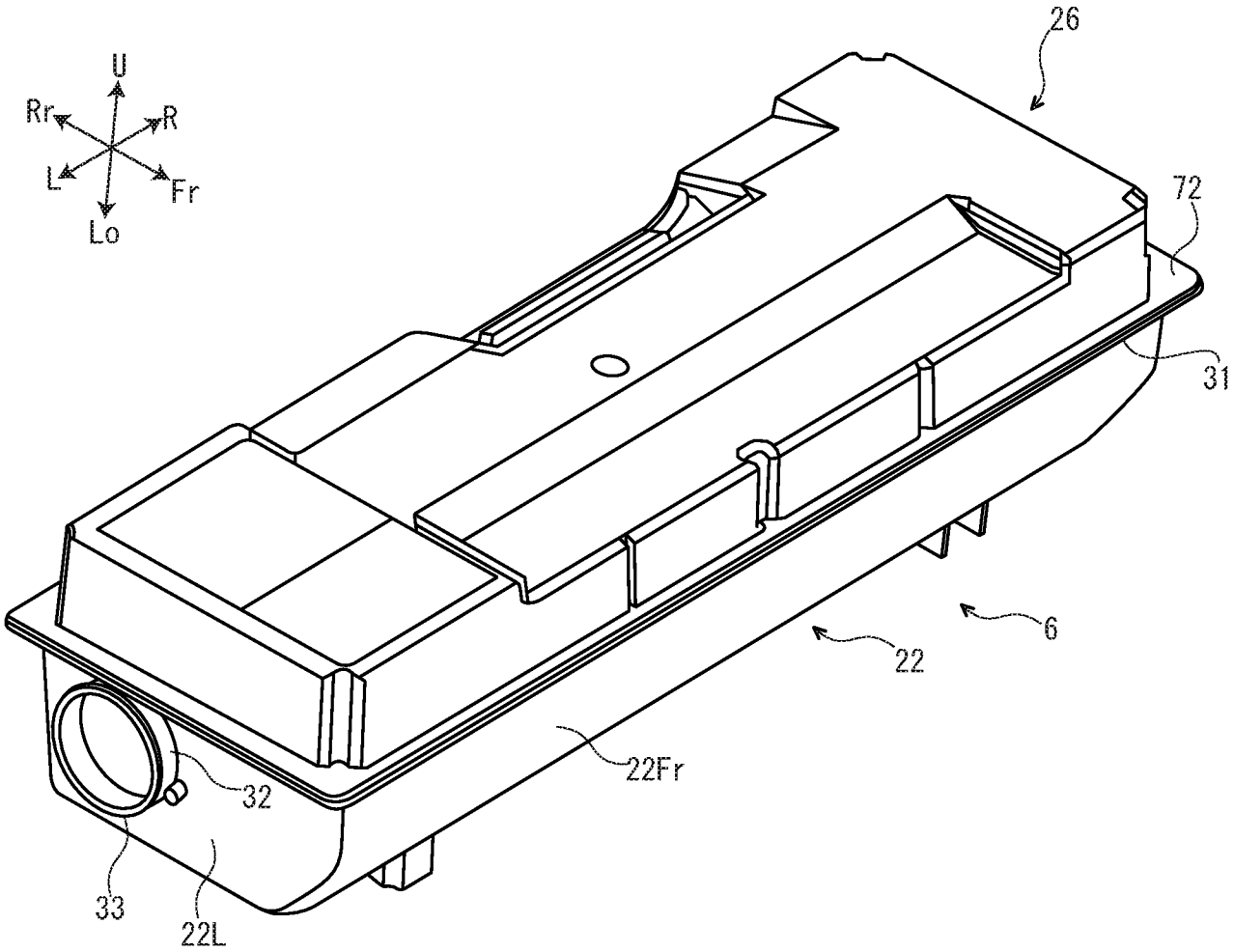
FIG. 4 is a perspective view showing the toner container according to the first embodiment of the present invention.

As shown in FIG. 4 and other figures, at an outer circumference of an upper end of the case main body 22, a main body side flange part 31 is formed. At a rear part of a left wall part 22L (a wall part at a side of the second space S2) of the case main body 22, a filling port through which the toner is filled is formed. The filling port 32 is closed by a cap 33. In addition, the cap 33 is not shown except in FIG. 4.

Figure 5:
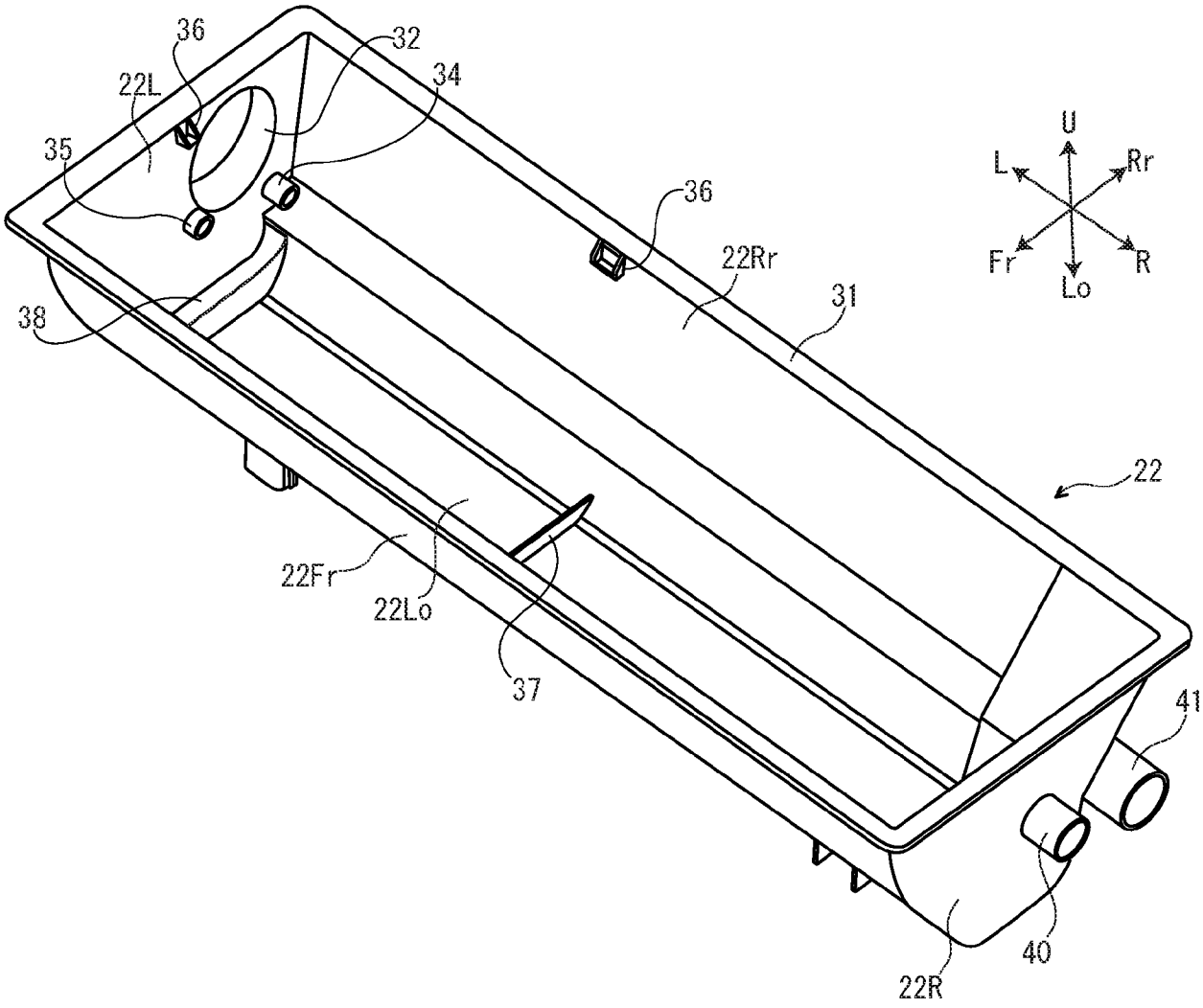
FIG. 5 is a perspective view showing a case main body of the toner container according to the first embodiment of the present invention.

As shown in FIG. 5 and other figures, at a lower rear part of a right face (an inner face) of the left wall part 22L of the case main body 22, a first main body side bearing part 34 is protruded. At a nearly center part of the right face of the left wall part 22L of the case main body 22, a second main body side bearing part 35 is protruded. At upper end parts of inner faces of the left wall part 22L and both front and rear wall parts 22Fr and 22Rr of the case main body 22, stoppers 36 are respectively protruded. At a nearly center part of an upper face (an inner face) of a lower wall part 22Lo of the case main body 22, an engaging protrusion part 37 (a first engaging part) is protruded. At a left side of the lower wall part 22Lo of the case main body 22, a step part 38 is formed. The step part 38 is positioned above the lower wall part 22Lo of the case main body 22. At a nearly center part of a right face (outer face) of a right wall part 22R (a wall part at a side of the first space S1) of the case main body 22, a cylindrical boss 40 is protruded.

Figure 6:
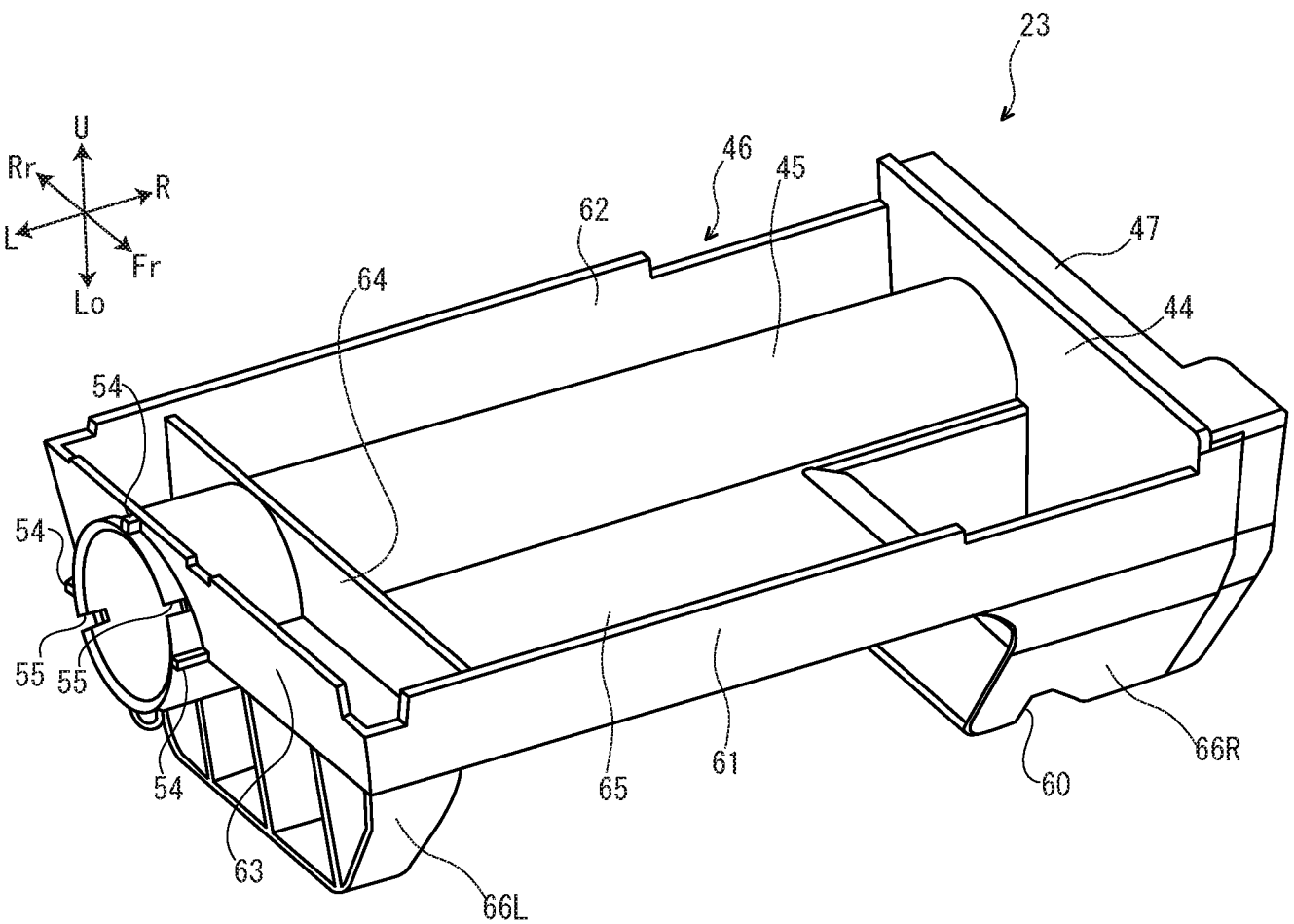
FIG. 6 is a perspective view showing a dividing member of the toner container according to the first embodiment of the present invention.
Figure 7:
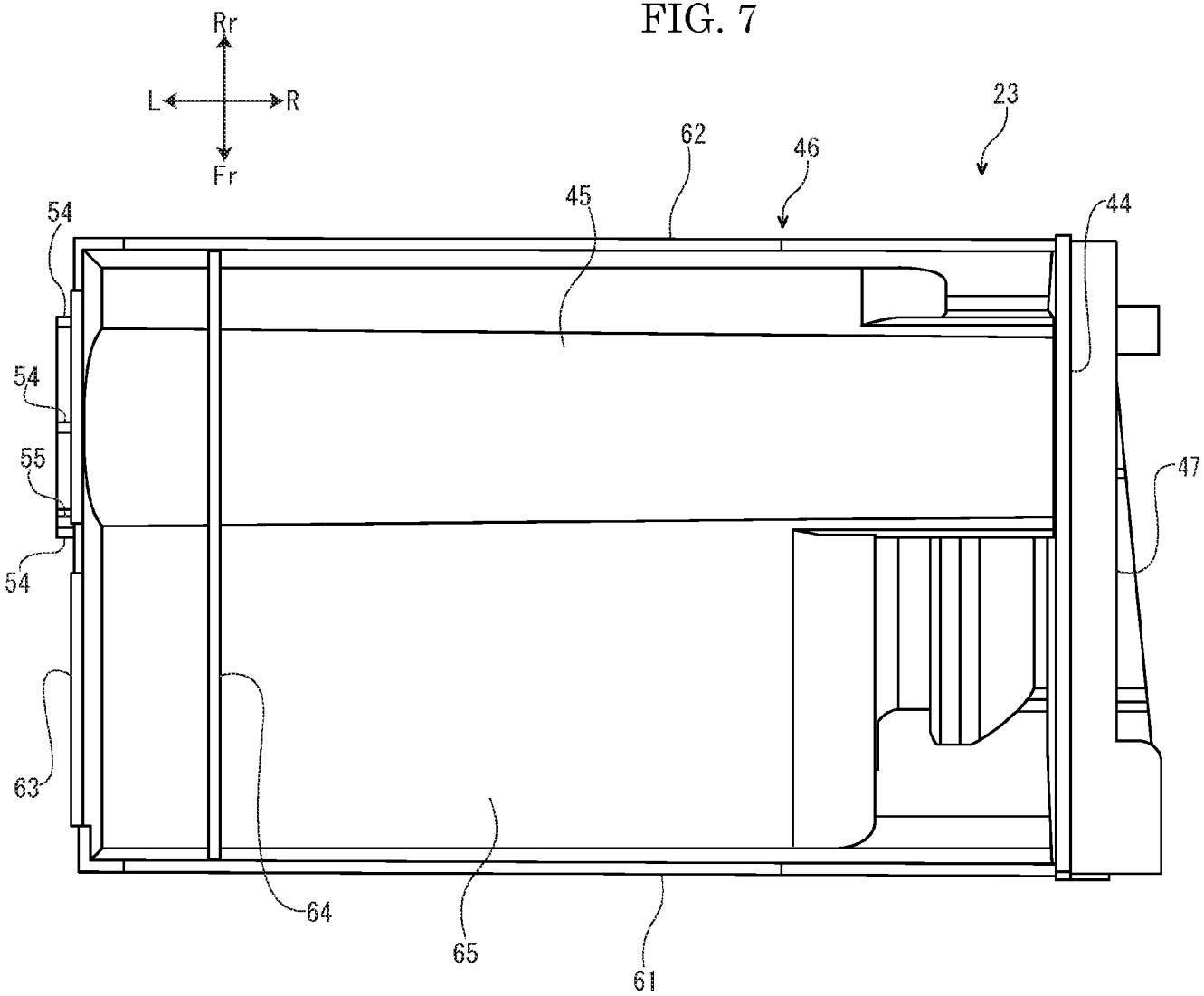
FIG. 7 is a plan view showing the dividing member of the toner container according to the first embodiment of the present invention.

As shown in FIGS. 6 and 7 and other figures, the dividing member 23 includes a dividing wall 44, a communication pipe 45 which is elongated leftward from a rear part of the dividing wall 44, a supporting frame 46 which supports the dividing wall 44 and the communication pipe 45, and a packing 47 (a sealing member) which is provided at a right side of the dividing wall 44.

As shown in FIG. 2 and other figures, the dividing wall 44 of the dividing member 23 is arranged in a nearly vertical posture. The dividing wall 44 divides the internal space of the case main body 22 in the left and right direction, and a right side of the dividing wall 44 is the first space S1 and a left side of the dividing wall 44 is the second space S2. At the rear part of the dividing wall 44, a circular inlet 50 is formed in the left and right direction. At a lower rear part of a right face (a face at the side of the first space S1) of the dividing wall 44, a first bearing part 52 is protruded. At a nearly center part of the right face of the dividing wall 44, a second bearing part 53 is protruded.

Figure 8:
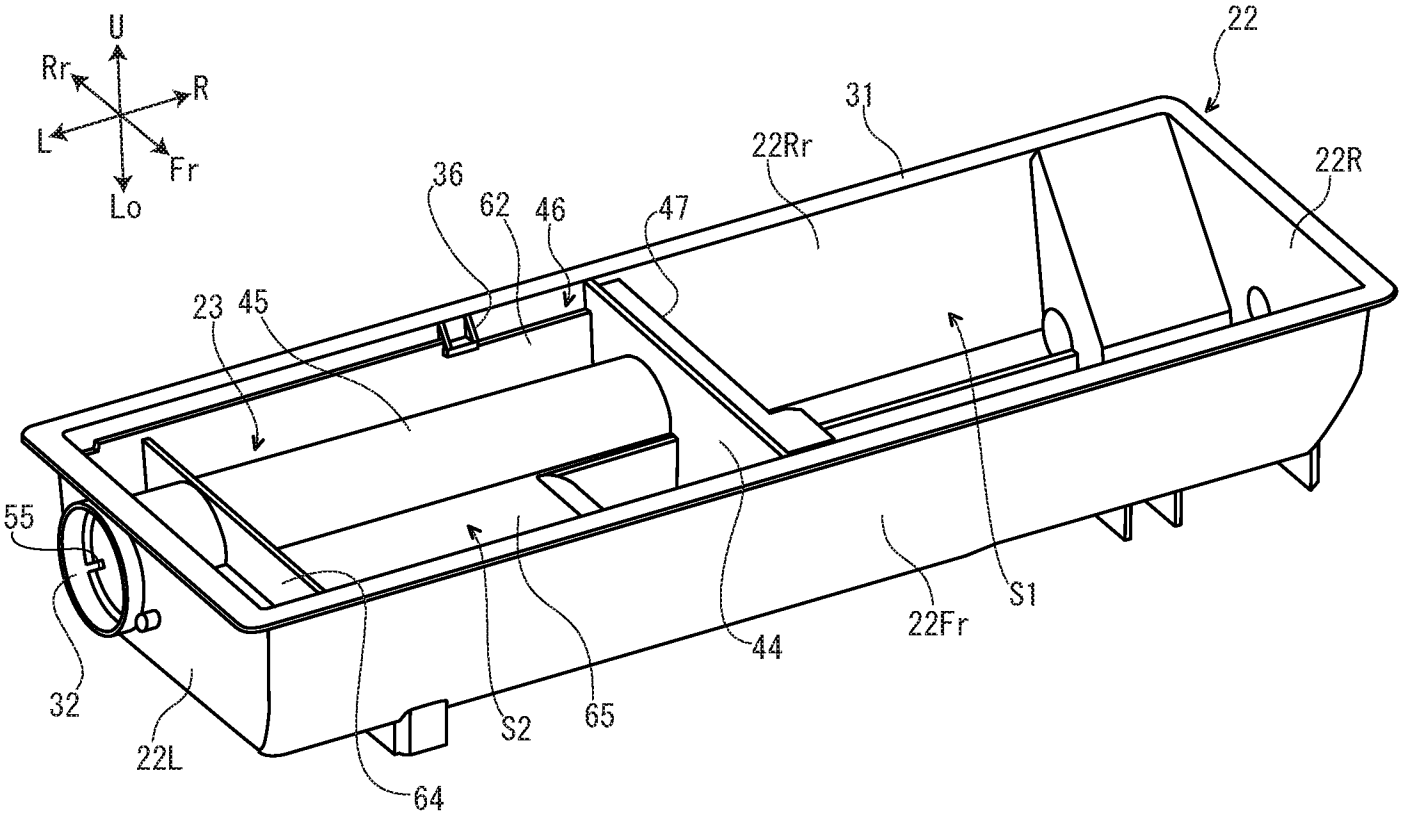
FIG. 8 is a perspective view showing the case main body and the dividing member of the toner container according to the first embodiment of the present invention.

As shown in FIG. 6 and other figures, the communication pipe 45 of the dividing member 23 is formed in a cylindrical shape elongated in the left and right direction. At an outer circumference of a left end part of the communication pipe 45, a plurality of ribs 54 are protruded with intervals in a circumferential direction. As shown in FIGS. 6 and 8, at the left end part (an end part at a side of the filling port 32) of the communication pipe 45, and between the neighboring ribs 54 (formation intervals of the ribs 54), a pair of fitting concave parts 55 (first fitting parts) are arranged so as to face each other. As shown in FIG. 2, the right end part of the communication pipe 45 is connected to the inlet 50 of the dividing wall 44. As shown in FIG. 8, a left end part of the communication pipe 45 is connected to the filling port 32 of the left wall part 22L (the wall part at the side of the second space S2) of the case main body 22. According to this configuration, the communication pipe 45 is installed between the left wall part 22L of the case main body 22 and the dividing wall 44, and the filling port 32 and the first space S1 are communicated via the communication pipe 45.

Figure 9A:
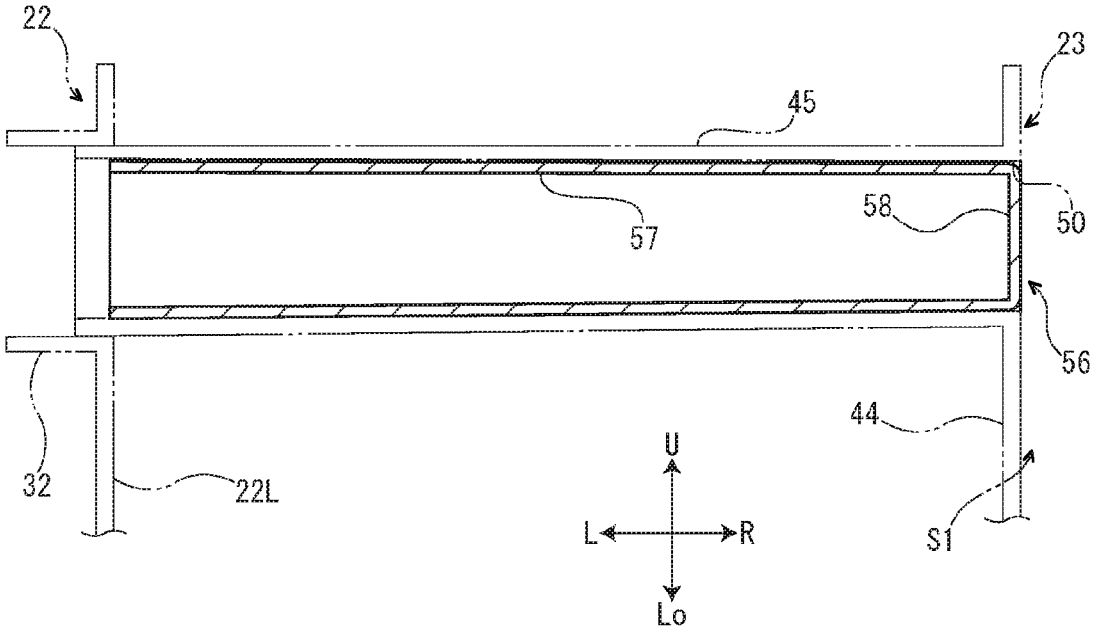
FIG. 9A is a sectional view showing a blocking member of the toner container according to the first embodiment of the present invention.
Figure 9B:
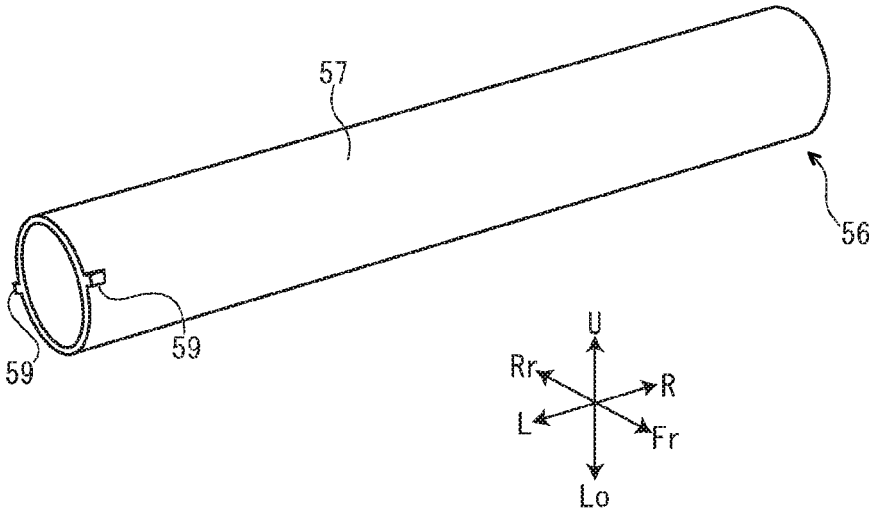
FIG. 9B is a perspective view showing the blocking member of the toner container according to the first embodiment of the present invention.

As shown in FIG. 9A, in the communication pipe 45 of the dividing member 23, a blocking member 56 of a bottomed cylindrical shape is inserted. Thus, the communication between the filling port 32 of the left wall part 22L of the case main body 22 and the first space S1 is blocked. The blocking member 56 includes a main body part 57 of a cylindrical shape which is elongated in the left and right direction, and a lid part 58 of a disk shape which closes an opening at a right end side (a side at the first space S1) of the main body part 57. The main body part 57 fits to an inner circumference of the communication pipe 45 of the dividing member 23. As shown in FIGS. 9A and 9B, at an outer circumference of a left end part (an end part at the side of the filling port 32) of the main body part 57, a pair of fitting convex parts 59 (second fitting parts) which are fittable to a pair of fitting concave parts 55 (see FIGS. 6 and 8 and other figures) formed in the communication pipe 45 of the dividing member 23 are formed. In addition, the blocking member 56 is not shown except in FIGS. 9A and 9B.

As shown in FIGS. 6 and 7, the supporting frame 46 of the dividing member 23 includes both front and rear frame parts 61 and 62 (a front frame part 61 and a rear frame part 62) which are formed at both front and rear sides of the communication pipe 45 and whose right end parts are connected to the dividing wall 44, a left frame part 63 which connects left end parts of the both front and rear frame parts 61 and 62 and a left end part of the communication pipe 45, a reinforcing frame part 64 which connects left side parts of the both front and rear frame parts 61 and 62 and a left side part of the communication pipe 45, a lower frame part 65 which connects lower end parts of the both front and rear frame parts 61 and 62, the left frame part 63 and the reinforcing frame part 64 and the communication pipe 45, and base frame parts 66R and 66L formed at a lower right side and a lower left side of the lower frame part 65.

As shown in FIG. 2 and other figures, upper edge parts of the both front and rear frame parts 61 and 62 (only the rear frame part 62 is shown in FIG. 2) and the left frame part 63 of the supporting frame 46 of the dividing member 23 come in contact with a lower face of each stopper 36 formed in the case main body 22. Thus, an upward coming-off of the dividing member 23 (displacement of the dividing member 23 in upper and lower direction (a direction which crosses to the left and right direction) with respect to the case main body 22) is restrained.

Figure 10:
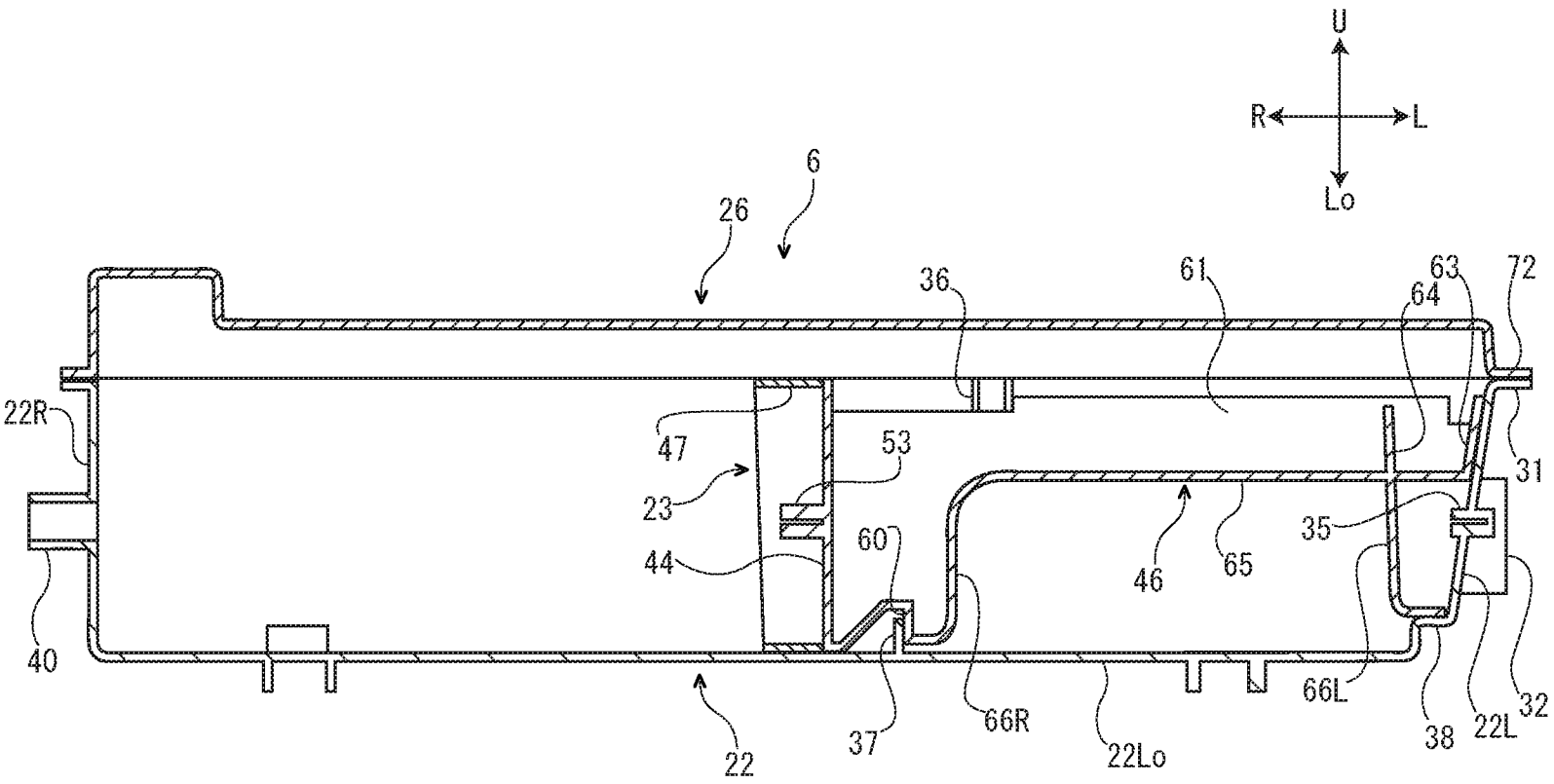
FIG. 10 is a sectional view showing the case main body, the dividing member and a covering body of the toner container according to the first embodiment of the present invention.

As shown in FIG. 10 and other figures, a lower face of the base frame part 66R at the right side (the left side in FIG. 10) of the dividing member 23 faces the upper face (the inner face) of the lower wall part 22Lo of the case main body 22. In the lower face of the base frame part 66R at the right side, an engagement groove 60 (a second engaging part) is formed. The engagement groove 60 engages with the engaging protrusion part 37 of the lower wall part 22Lo of the case main body 22. Thus, displacement of the dividing member 23 in the left and right direction with respect to the case main body 22 is restrained. A lower end part of the base frame part 66L at the left side (the right side in FIG. 10) of the dividing member 23 is in contact with the step part 38 of the case main body 22.

As shown in FIG. 2 and other figures, the packing 47 of the dividing member 23 is arranged along an outer edge of the right face (a face at the side of the first space S1) of the dividing wall 44. The packing 47 is formed in a square frame shape, and provided all around the outer edge of the right face of the dividing wall 44. The packing 47 is made of an elastic material, such as a rubber.

As shown in FIG. 2, the conveying screw 24 is formed in a shape elongated in the left and right direction. The conveying screw 24 is rotatably housed in the first space S1 of the case main body 22. A right side part of the conveying screw 24 is inserted in the discharging duct 41 of the case main body 22. The conveying screw 24 includes a screw shaft 67 of a bar shape and a spiral fin 68 formed around this screw shaft 67. A left end part of the screw shaft 67 is rotatably supported by the first bearing part 52 formed in the dividing wall 44 of the dividing member 23. The right end part of the screw shaft 67 protrudes to right side of the discharging duct 41 of the case main body 22, and, to this protruding part, a conveying gear 69 (see FIG. 3) is fixed.

As shown in FIG. 2, the agitating paddle 25 is formed in a shape elongated in the left and right direction. The agitating paddle 25 is rotatably housed in the first space S1 of the case main body 22. The agitating paddle 25 includes a frame body 71, and an agitating vane (not shown) supported by the frame body 71. A left end part of the frame body 71 is rotatably supported by the second bearing part 53 formed in the dividing wall 44 of the dividing member 23. A right end part of the frame body 71 is pivotally supported by the right wall part 22R of the case main body 22.

As shown in FIG. 4 and other figures, at an outer circumference of a lower end of the covering body 26, a covering body side flange part 72 having a shape corresponding to the main body side flange part 31 of the case main body 22 is formed. Further, the main body side flange part 31 and the covering body side flange part 72 are ultrasonic welded so that the case main body 22 and the covering body 26 are unified.

Figure 11:
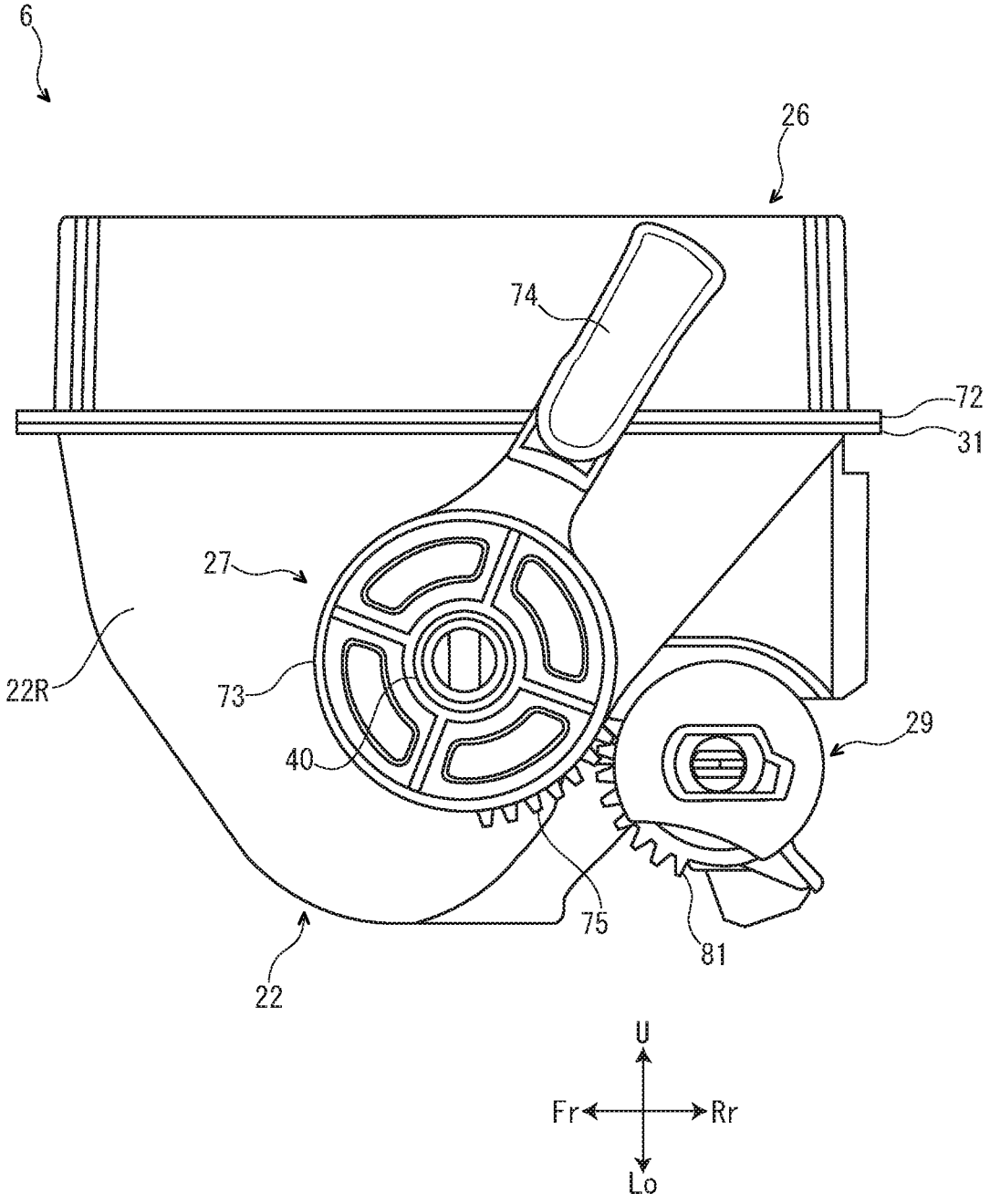
FIG. 11 is a side view showing the toner container according to the first embodiment of the present invention.

As shown in FIG. 11 and other figures, the lever 27 is rotatably supported by the boss 40 of the right wall part 22R of the case main body 22. The lever 27 includes a lever main body 73 which has a circular outline in a side view, and a grip part 74 which protrudes upward from the lever main body 73. At a lower rear part of the lever main body 73, a lever side gear 75 is formed.

As shown in FIG. 3, the transmitting member 28 includes a disk-shaped transmitting member main body 76, a coupling 77 which is protruded on a right face (outer face) of the transmitting member main body 76, and a joint 78 which is protruded on a left face (inner face) of the transmitting member main body 76. At an outer circumference of the transmitting member main body 76, a transmission gear 79 is formed. The transmission gear 79 meshes with the conveying gear 69 fixed to the screw shaft of the conveying screw 24. The coupling 77 is connected to a drive source (not shown) composed of a motor or the like. The joint 78 is coupled to the frame body 71 (see FIG. 2) of the agitating paddle 25 while penetrating through the boss 40 of the right wall part 22R of the case main body 22.

As shown in FIG. 3, the shutter 29 is formed in a lateral cylindrical shape. The shutter 29 is rotatably attached to an outer circumference of the discharging duct of the case main body 22. In the shutter 29, an opening part 80 is formed. At the outer circumference of the shutter 29, a shutter side gear 81 is formed. The shutter side gear 81 meshes with the lever side gear 75 of the lever main body 73 of the lever 27, and the discharging port 42 of the discharging duct 41 of the case main body 22 is configured to open and close when the shutter 29 is rotated in a direction opposite to the lever 27 according to a rotation of the lever 27.

When a toner filled in the first space S1 of the case main body 22 is discharged in the toner container 6 applying the above-mentioned configuration, the drive source (not shown) rotates the transmitting member 28. When the transmitting member 28 is rotated in this way, the agitating paddle 25 coupled to the transmitting member 28 is rotated so as to convey the toner in the case main body 22 toward the conveying screw 24 while agitating the toner. Further, when the transmitting member 28 is rotated as described above, this rotation is transmitted to the conveying screw 24 and the conveying screw 24 is rotated. According to this, the toner filled in the first space S1 of the case main body 22 is discharged from the discharging port 42.

In addition, the second space S2 of the case main body 22 is divided from the first space S1 by the dividing wall 44 of the dividing member 23, and restrained from communication with the discharging port 42. Hence, if the toner were filled in the second space S2, the toner would not be discharged from the second space S2.

Further, when a toner is filled in the first space S1 of the case main body 22 in the toner container 6 applying the above-mentioned configuration, an operator fixes the dividing member 23 to the case main body 22, and fills the toner from the filling port 32 of the case main body 22. The toner filled from the filling port 32 in this way passes through the communication pipe 45 of the dividing member 23, filled to the first space S1 of the case main body 22 through the inlet 50 of the dividing wall 44 of the dividing member 23, and is contained in the first space S1.

In addition, the second space S2 of the case main body 22 is divided from the first space S1 by the dividing wall 44 of the dividing member 23 and restrained from communication with the filling port 32. Hence, the toner is prevented from being filled to the second space S2. Therefore, in the second space S2, the toner is not contained.

When the filling of the toner to the first space S1 is finished, the operator inserts the blocking member 56 in the communication pipe 45 of the dividing member 23, and blocks the communication of the filling port 32 of the case main body 22 with the first space S1. Then, the operator closes the filling port 32 of the case main body 22 by the cap 33.

As described above, the toner container 6 according to the present embodiment includes the dividing member 23 which divides the internal space of the case main body 22 into the first space S1 communicated with the filling port 32 and the discharging port 42 and the second space S2 restrained from communication with the filling port 32 and the discharging port 42. By applying such a configuration, it is possible to vary a filling amount of the toner to the case main body 22 according to a specification of the printer 1 while simplifying a configuration of the printer 1.

For example, in the toner container 6 for a high speed machine (the printer 1 with a high printing speed), a position of the dividing wall 44 of the dividing member 23 is set closer to a left side (the side of the second space S2) compared to the toner container 6 for a low speed machine (the printer 1 with a low printing speed). Consequently, it is possible to increase a filling amount of the toner to the toner container 6 for the high speed machine compared to the filling amount of the toner to the toner container 6 of the low speed machine.

Further, among a plurality of toner containers 6 which have different volumes (filling amounts of the toner), a user can select the toner container 6 having a volume satisfying a desired printing number. For example, a user who frequently uses a toner (who frequently prints sheets) may select the toner container 6 having a larger volume even though the toner container 6 is expensive. On the other hand, a user who does not frequently use a toner (who does not frequently print sheets) may select a low cost toner container 6 even though the toner container 6 has a smaller volume.

Further, in the left wall part 22L (the wall part at the side of the second space S2) of the case main body 22, the filling port 32 is arranged, and the dividing member 23 includes the dividing wall 44 which divides the internal space of the case main body 22 into the first space S1 and the second space S2 and the communication pipe 45 which is installed between the left wall part 22L of the case main body 22 and the dividing wall 44, and communicates the filling port 32 with the first space S1. By applying such a configuration, it is possible to reliably fill the toner to the first space S1 via the communication pipe 45.

Further, the toner container 6 includes the blocking member 56 which is inserted in the communication pipe 45, and this blocking member 56 blocks the communication of the filling port 32 with the first space S1. By applying such a configuration, it is possible to prevent the toner filled in the first space S1 from leaking to an outside via the communication pipe 45.

Further, the toner container 6 includes the conveying screw 24 and the agitating paddle 25 which are rotatably housed in the first space S1, and, at the right face (the face at the side of the first space S1) of the dividing wall 44 of the dividing member 23, the first bearing part 52 which rotatably supports the left end part of the screw shaft 67 of the conveying screw 24 and the second bearing part 53 which rotatably supports the left end part of the frame body 71 of the agitating paddle 25 are arranged. By applying such a configuration, it is possible to use the dividing wall 44 which divides the first space S1 and the second space S2 as a bearing of the conveying screw 24 and the agitating paddle 25.

Further, the dividing member 23 includes the packing 47 which is arranged along the outer edge of the right face (the face at the side of the first space S1) of the dividing wall 44. By applying such a configuration, it is possible to enhance airtightness of the first space S1, and prevent a toner from leaking from the first space S1 to the second space S2.

Further, the dividing wall 44 of the dividing member 23 divides the internal space of the case main body in the left and right direction (the longitudinal direction of the case main body 22). By applying such a configuration, it is possible to form the first space S1 in the right side part (one side part in the longitudinal direction) of the case main body 22, and form the second space S2 in the left side part (the other side part in the longitudinal direction) of the case main body 22.

Further, in the case main body 22, only at the part corresponding to the first space S1, the discharging port 42 is arranged (at a part corresponding to the second space S2, the discharging port 42 is not arranged). Consequently, it is possible to discharge the toner from the first space S1, and prevent the toner from being discharged from the second space S2.

In the present embodiment, a case where the filling amount of the toner to the case main body 22 is varied according to the specification (printing speed) of the printer 1 has been described. Meanwhile, in other different embodiments, according to a destination of the printer 1 or a color of a toner filled to the case main body 22, the filling amount of the toner to the case main body 22 may be varied.

In the present embodiment, a case where the configuration of the present invention is applied to the toner container 6 has been described. Meanwhile, in the other different embodiments, the configuration of the present invention may be applied to a toner case other than the toner container 6, such as a disposal toner bottle. That is, the configuration of the present invention is applicable to all toner cases to which a toner can be filled.

In the present embodiment, a case where the configuration of the present invention is applied to the printer 1 has been described. However, in the other different embodiments, the configuration of the present invention may be applied to an image forming apparatus other than a printer, such as a copying machine, a facsimile or a multifunction peripheral.

Second Embodiment

Next, a toner container 90 (toner case) according to the second embodiment will be described with reference to FIG. 12. In addition, components other than a dividing member 91 are the same as the components in the first embodiment, and therefore will be assigned in FIG. 12 by the same reference numeral as the first embodiment and will not be explained.

The dividing member 91 includes a dividing wall part 93 and a dividing member side flange part 94 which is formed at an outer circumference of an upper end of the dividing wall part 93.

Figure 12:
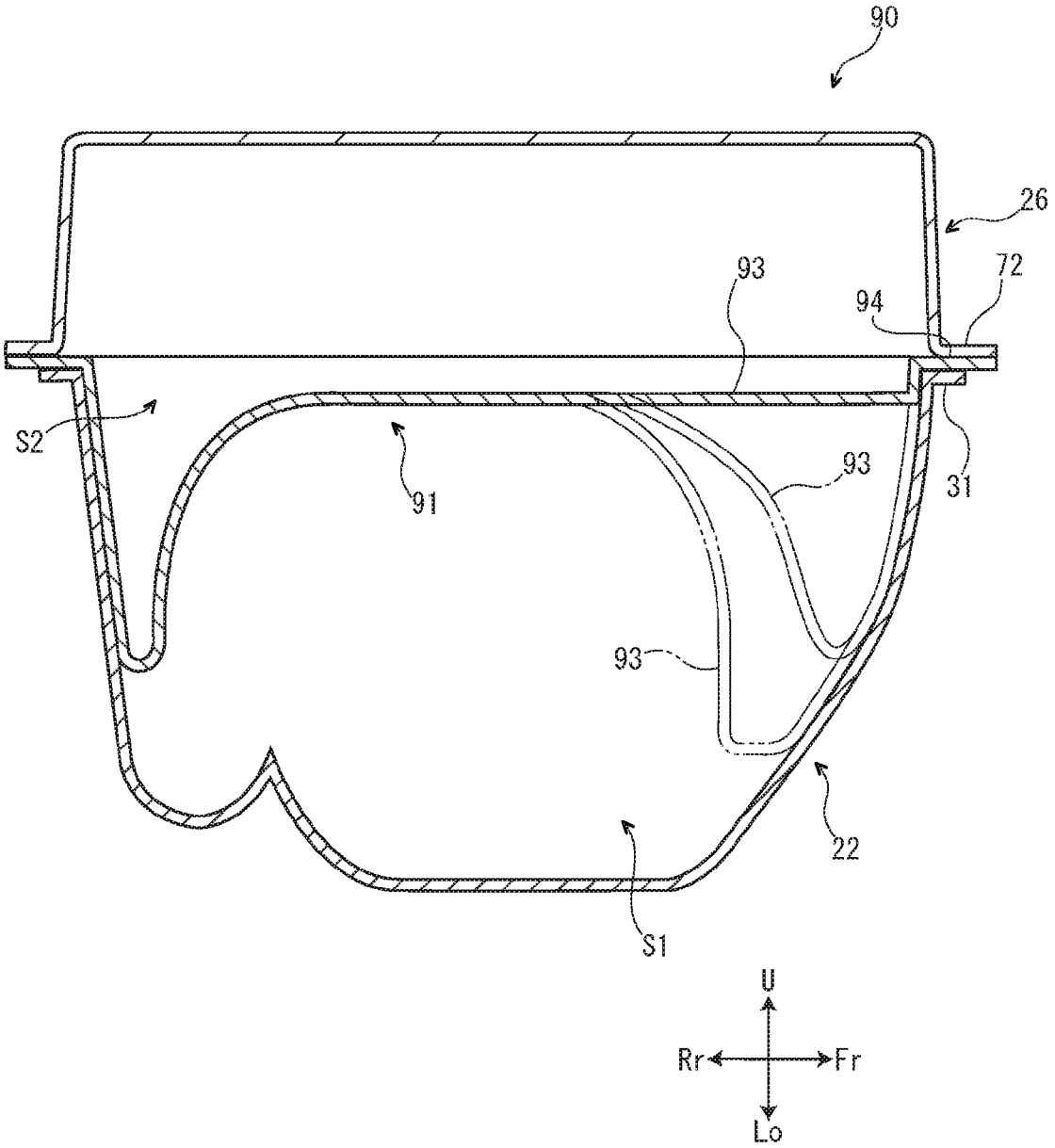
FIG. 12 is a sectional view showing a toner container according to a second embodiment of the present invention.

A position of the dividing wall part 93 indicated by a solid line in FIG. 12 is a position of the dividing wall part 93 of the toner container 90 for a high-speed machine (the printer 1 of a high printing speed), for example. The position of the dividing wall part 93 indicated by a one-dot chain line in FIG. 12 is the position of the dividing wall part 93 of the toner container 90 for a middle-speed machine (the printer 1 of a middle printing speed). The position of the dividing wall part 93 indicated by a two-dot chain line in FIG. 12 is the position of the dividing wall part 93 of the toner container 90 for a low-speed machine (the printer 1 of the low printing speed). The toner container 90 for the high-speed machine has the largest volume of the first space S1 (the filling amount of the toner to the first space S1), the toner container 90 for the middle-speed machine has the second largest volume, and the toner container 90 for the low-speed machine has the smallest volume. By applying such a configuration, while simplifying a configuration of the printer 1, it is possible to vary the filling amount of the toner to the case main body 22 according to a specification (printing speed) of the printer 1.

The dividing wall part 93 divides the internal space of the case main body 22 in the upper and lower direction (the direction which crosses to the longitudinal direction (left and right direction) of the case main body 22). By applying such a configuration, it is possible to form the first space S1 in the lower part (one side part in the upper and lower direction) of the case main body 22, and form the second space S2 in the upper part (the other side part in the upper and lower direction) of the case main body 22.

The dividing member side flange part 94 is welded to the main body side flange part 31 and the covering body side flange part 72 when the main body side flange part 31 of the case main body 22 and the covering body side flange part 72 of the covering body 26 are welded. That is, the main body side flange part 31, the covering body side flange part 72 and the dividing member side flange part 94 are welded at once. Consequently, it is possible to prevent a process of manufacturing the toner container 90 from becoming complex.

What is claimed is:

1. A toner case comprising:

a case main body configured to have a filling port through which a toner is filled and a discharging port through which the toner is discharged; and a dividing member configured to divide an internal space of the case main body into a first space communicated with the filling port and the discharging port and a second space restrained from communication with the filling port and the discharging port, wherein the filling port is arranged in a wall part of the case main body at a side of the second space, and the dividing member includes:

a dividing wall configured to divide the internal space of the case main body into the first space and the second space; and a communication pipe installed between the wall part of the case main body at the side of the second space and the dividing wall so as to communicate the filling port with the first space.

2. The toner case according to claim 1, further comprising a blocking member inserted in the communication pipe and configured to block the communication of the filling port with the first space.

3. The toner case according to claim 2, wherein the blocking member includes:

a cylindrical main body part configured to fit to an inner circumference of the communication pipe; and a lid part configured to close an opening of the main body part at a side of the first space.

4. The toner case according to claim 3, wherein a first fitting part is arranged at an end part of the communication pipe at a side of the filling port, and a second fitting part being fittable to the first fitting part is arranged at an outer circumference of an end part of the main body part at the side of the filling port.

5. The toner case according to claim 1, wherein a first engaging part is arranged in an inner face of the case main body, and the dividing member further includes a supporting frame configured to support the dividing wall and the communication pipe, and the supporting frame has a second engaging part being engagable with the first engaging part and arranged in a face facing the inner face of the case main body.

6. The toner case according to claim 5, wherein a stopper is protruded on the inner face of the case main body, and the supporting frame comes into contact with the stopper so that the dividing member is restrained from coming off upwardly.

7. The toner case according to claim 1, further comprising a rotating member rotatably housed in the first space, wherein a bearing part configured to rotatably support one end part of the rotating member is arranged in a face of the dividing wall at a side of the first space.

8. The toner case according to claim 1, wherein the dividing member further includes a sealing member arranged along an outer edge of a face of the dividing wall at a side of the first space.

9. The toner case according to claim 1, wherein the dividing member divides the internal space of the case main body in a longitudinal direction of the case main body.

10. The toner case according to claim 1, wherein the discharging port is arranged at a part corresponding to the first space of the case main body.

11. An image forming apparatus comprising:

the toner case according to claim 1; and an image forming part configured to perform an image forming operation by using a toner supplied from the toner case.

* * * * *